US006350293B1

(12) United States Patent
Carter, Jr. et al.

(10) Patent No.: US 6,350,293 B1
(45) Date of Patent: Feb. 26, 2002

(54) BOTTOM POUR ELECTROSLAG REFINING SYSTEMS AND METHODS

(75) Inventors: William Thomas Carter, Jr., Galway; Mark Gilbert Benz, Burnt Hills, both of NY (US); Felix Guenter Muller, Biebergemuend; Franz Waldemar Hugo, Aschaffenburg, both of (DE); Robert John Zabala, Schenectady; Bruce Alan Knudsen, Amsterdam, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/511,198

(22) Filed: Feb. 23, 2000

Related U.S. Application Data

(60) Provisional application No. 60/121,185, filed on Feb. 23, 1999.

(51) Int. Cl.[7] ..... C22B 9/18; C22B 9/187

(52) U.S. Cl. ..... 75/10.24; 266/201; 373/45; 373/47; 373/48

(58) Field of Search ..... 75/10.24; 266/201; 373/45, 47, 48

(56) References Cited

U.S. PATENT DOCUMENTS

| | | | | |
|---|---|---|---|---|
| 3,610,318 | A | * 10/1971 | Simmons | 164/252 |
| 3,945,818 | A | 3/1976 | Paton et al. | |
| 4,449,568 | A | 5/1984 | Narasimham | |
| 4,591,454 | A | 5/1986 | Ohtsuka et al. | |
| 5,160,532 | A | 11/1992 | Benz et al. | |
| 5,174,811 | A | 12/1992 | Schmidt et al. | |
| 5,310,164 | A | 5/1994 | Benz et al. | |
| 5,325,906 | A | 7/1994 | Benz et al. | |
| 5,348,566 | A | 9/1994 | Sawyer et al. | |
| 5,381,847 | A | 1/1995 | Asok et al. | |
| 5,472,177 | A | 12/1995 | Benz et al. | |
| 5,480,097 | A | 1/1996 | Carter, Jr. et al. | |
| 5,649,992 | A | 7/1997 | Carter, Jr. et al. | |
| 5,649,993 | A | 7/1997 | Carter, Jr. et al. | |
| 5,683,653 | A | 11/1997 | Benz et al. | |
| 5,769,151 | A | 6/1998 | Carter, Jr. et al. | |
| 5,809,057 | A | 9/1998 | Benz et al. | |
| 5,810,066 | A | 9/1998 | Knudsen et al. | |

FOREIGN PATENT DOCUMENTS

| | | |
|---|---|---|
| DE | 19614182 | 7/1997 |
| EP | 199199 A2 | 10/1986 |

OTHER PUBLICATIONS

European Search Report Aug. 17, 2000.

* cited by examiner

*Primary Examiner*—Roy King
*Assistant Examiner*—Tima M. McGuthry-Banks
(74) *Attorney, Agent, or Firm*—Robert P. Santandrea; Noreen C. Johnson

(57) ABSTRACT

A bottom pour electroslag refining system refines raw material into refined liquid metal. The bottom pour electroslag refining system comprises an electroslag refining crucible; a slag; a bottom pour structure that comprises an orifice from which refined liquid metal from the electroslag refining crucible can flow as a stream of refined liquid metal; and a current path. The current path is defined in the bottom pour electroslag refining system for applying current to the raw material for melting and refining the raw material. The melted and refined raw material forms a refined liquid metal pool in the electroslag refining crucible. The current that is applied by the current path is sufficient to provide the refined liquid metal in the refined liquid metal pool with a viscosity under which the refined liquid metal can flow through the orifice under its own viscosity.

13 Claims, 1 Drawing Sheet

BOTTOM POUR ELECTROSLAG REFINING SYSTEMS AND METHODS

This application claims priority of a Provisional Application entitled "Bottom Pour for Electroslag Refining Systems" by Carter et al. U.S. Ser. No. 60/121,185, filed Feb. 23, 1999.

The invention was developed under a program funded under DARPA contract F33615-96-2-5263. The government has rights in this invention under the contract.

BACKGROUND OF THE INVENTION

The invention relates to electroslag refining systems and methods for electroslag refining. In particular, the invention related to bottom pour electroslag refining systems and methods.

Electroslag refining (ESR) comprises a process that is generally used to melt and refine various metals. For example and in no way limiting of the invention, iron (Fe), nickel (Ni), cobalt (Co), and titanium (Ti) based metals and alloys can be refined by an electroslag refining system and process. Typically, electroslag refining system comprises an consumable electrode formed from the alloy to be melted and refined, a liquid slag, and a cooled crucible, such as but not limited to a water-cooled copper crucible. The liquid slag can be heated by passing an electric current from a suitable current source to the consumable electrode then through the liquid slag and then to the crucible.

The liquid slag is maintained at a temperature that is high enough to melt the consumable electrode. A refining process occurs as the consumable electrode melts and passes through the liquid slag. Also, inclusions, such as oxide inclusions, are exposed to the liquid slag and are dissolved, thus further refining the metal. The refining process includes the melting of metal from the consumable electrode and the formation of molten metal droplets. These droplets fall, for example by gravity, through the liquid slag, and are collected in a liquid metal pool. The pool is contained by the crucible, which is generally disposed below the pool.

Electroslag refining systems generally include an induction-heated, segmented, water-cooled copper guide tube or cold induction guide (CIG). The cold induction guide is typically connected to the bottom of the electroslag refining system crucible. The cold induction guide includes an orifice from which a refined metal liquid stream can be extracted therefrom. This stream can be used as a liquid metal source for many solidification processes, including, but not limited to, powder atomization, spray deposition, investment casting, melt-spinning, strip casting, slab casting, and nucleated casting. Electroslag refining systems and cold induction guide structures are known in the art, for example as set forth in U.S. Pat. No. 5,160,532 to Benz et al., which is assigned to the Assignee of the instant invention and fully incorporated by reference.

While known electroslag refining systems are effective in refining of metals, a cold induction guide structure may be used for facilitating a flow of refined liquid metal out of the electroslag refining system. The use of a cold induction guide structure includes the addition of further current and heat to the electroslag refining system. Of course, this addition current and heat adds costs to the refining process. Also, the additional heat and current may provide insulation concerns, including heat and electrical insulation concerns.

Therefore, a need exists for an electroslag refining system that avoids adding additional heat and current to the electroslag refining system for facilitating refined liquid metal flow.

SUMMARY OF THE INVENTION

An aspect of the invention provides a bottom pour electroslag refining system. A bottom pour electroslag refining system refines raw material from a source of raw material into refined liquid metal. The bottom pour electroslag refining system comprises an electroslag refining crucible; a slag; a bottom pour structure that comprises an orifice from which refined liquid metal from the electroslag refining crucible can flow as a stream of refined liquid metal; and a current path. The current path is defined in the bottom pour electroslag refining system for applying current to the raw material for melting and refining the raw material. The melted and refined raw material forms a refined liquid metal pool in the electroslag refining crucible. The current that is applied by the current path is sufficient to provide the refined liquid metal in the refined liquid metal pool with a viscosity under which the refined liquid metal can flow through the orifice under its own viscosity.

A further aspect of the invention provides a bottom pour electroslag refining method for refining raw material from a source of raw material into refined liquid metal in which the refined liquid metal can flow under its own viscosity. The method comprises providing raw material to be refined; providing an electroslag refining crucible; providing a slag in the electroslag refining crucible; providing a bottom pour structure for the electroslag refining crucible comprising an orifice from which refined liquid metal from the electroslag refining crucible can flow as a stream of refined liquid metal; establishing a current path; applying current to the raw material from the source of raw material for melting and refining the raw material; and forming a refined liquid metal pool in the electroslag refining crucible. The step of applying current comprises applying current at an amount that is sufficient to provide the refined liquid metal in the refined liquid metal pool with a viscosity so the refined liquid metal can flow out of the orifice under its own viscosity.

Another aspect of the invention provides a bottom pour electroslag refining method for refining raw material from a source of raw material into refined liquid metal in which the refined liquid metal can flow under its own viscosity. The method comprises providing raw material to be refined; providing an electroslag refining crucible; providing a slag in the electroslag refining crucible; providing a bottom pour structure for the electroslag refining crucible comprising an orifice from which refined liquid metal from the electroslag refining crucible can flow as a stream of refined liquid metal; establishing a current path; applying current to the raw material from the source of raw material for melting and refining the raw material; and forming a refined liquid metal pool in the electroslag refining crucible. The step of applying current comprises applying current at an amount that is sufficient to provide the refined liquid metal in the refined liquid metal pool with a viscosity so the refined liquid metal can flow out of the orifice under its own viscosity. The step of applying current comprises at least one of: establishing a refined liquid metal pool that comprises a depth sufficient for the refined liquid metal to maintain a viscosity under which the refined liquid metal pool can flow through the orifice under its own viscosity; and applying current at a level that is sufficient to heat the refined liquid metal pool to a temperature in which the refined liquid metal pool maintains a viscosity under which the refined liquid metal can flow through the orifice under its own viscosity.

Another aspect of the invention sets forth a bottom pour system for electroslag refining of raw metallic material. The bottom pour system comprises means for electroslag refining; means for applying an electrical current to the means for electroslag refining; and means for producing a refined liquid metal pool. The current applied by means for applying current is sufficient to provide refined liquid metal in the refined liquid metal pool with a viscosity under which the refined liquid metal can flow through under its own viscosity.

These and other aspects, advantages and salient features of the invention will become apparent from the following detailed description, which, when taken in conjunction with the annexed drawings, where like parts are designated by like reference characters throughout the drawings, disclose embodiments of the invention.

DETAILED DESCRIPTION OF THE INVENTION

Figure 1:
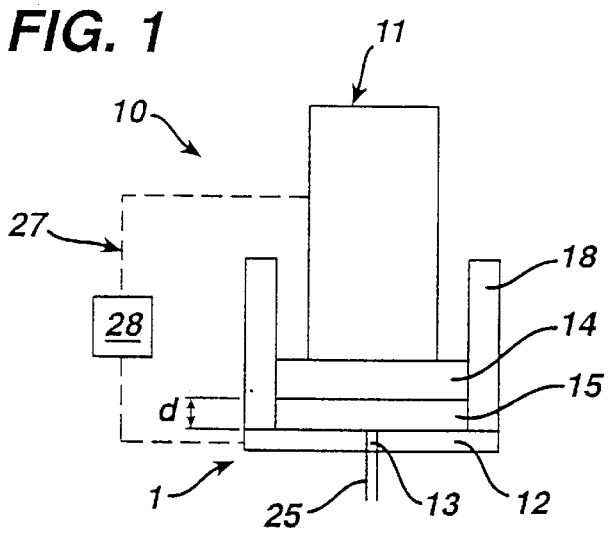
FIG. 1 is a part-sectional, side schematic illustration of one bottom pour structure, as embodied by the invention, for an electroslag refining system.

The bottom pour structure, as embodied by the invention, can be provided with refining systems, to provide the refining system with an outlet for dispensing a stream of refined liquid metal. The provision of a bottom pour structure, as embodied by the invention, avoids the need for a cold induction guide structure, if the refined liquid metal in the refining system is sufficiently heated to form a stream without added heating, such as by induction heaters of a cold induction guide structure. The refining system may comprise any appropriate metal melting and refining system, such as but not limited to electroslag refining systems, vacuum induction melt (VIM) systems, vacuum arc remelting (VAR) systems, and other such systems that pertain to the purification of metals. The following description of an electroslag refining system is merely exemplary, and this description is not intended to limit the invention in any manner.

The bottom pour structure for an electroslag refining system, as embodied by the invention, can rely solely on heat that is generated by an electroslag refining system to permit a stream of refined liquid metal to flow therefrom. The bottom pour structure for an electroslag refining system does not rely on heat generated by a cold induction guide structure for dispensing a stream of refined liquid metal. The bottom pour structure for an electroslag refining system, as embodied by the invention, permits bottom pouring of a stream of refined liquid metal, in which the stream of refined liquid metal can be controlled by the amount of heat applied to the electroslag refining system. Additionally, the bottom pour structure for an electroslag refining system does not rely on heat generated by any other outside power supply, regardless of the form of the power supply.

Electroslag refining systems can produce a liquid metal stream that can flow through an electroslag refining system orifice (hereinafter "orifice"), in the absence of cold induction power under certain operating conditions. One of these conditions may occur when a refined metal liquid level in a crucible of the electroslag refining system is sufficiently low. The refined metal liquid level will be sufficiently low when energy, which is applied to melt and refine the metal, can maintain the refined liquid metal sufficiently viscous, which means that the viscosity of the refined liquid metal is sufficient for refined liquid metal to flow through the orifice without requiring further heating. The refined liquid metal that has been refined under these conditions will maintain sufficient viscosity for flow without further heating, for example heating originating from a cold induction guide structure.

Another operating condition that can produce a liquid metal stream flowing through an orifice in the absence of cold induction power under certain operating conditions may occur under electroslag refining conditions at high temperatures. The high temperatures, as embodied by the invention, comprise temperatures generated by passing a current through the electroslag refining system for electroslag refining. The exact temperature may vary depending on the metal being refined, refining conditions, degree of fluidity desired, and other such factors. The current is supplied from an appropriate current source and heats up the electrode. Heat is passed to the refined liquid metal regardless of the source of the refined liquid metal. For example, the refined liquid metal may be metal that is melted from a consumable electrode and thereafter refined. Alternatively, the metal for melting and refining may originate from a source other than the electrode. The heated refined liquid metal is heated to sufficiently high temperatures in that the viscosity is sufficient for refined liquid metal flow out of the orifice, without additional application of heat. Therefore, heating, for example, by an induction heater, such as in a cold induction guide structure, need not be applied to the electroslag refining system with a bottom pour structure, as embodied by the invention.

Figure 2:
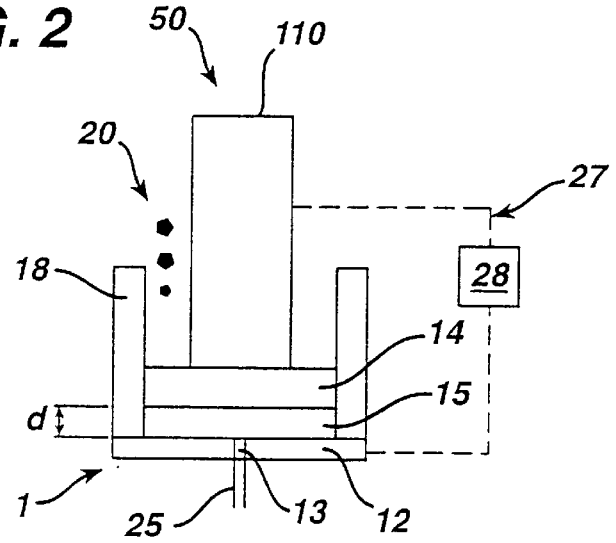
FIG. 2 is a part-sectional, side schematic illustration of another bottom pour structure, as embodied by the invention.
Figure 3:
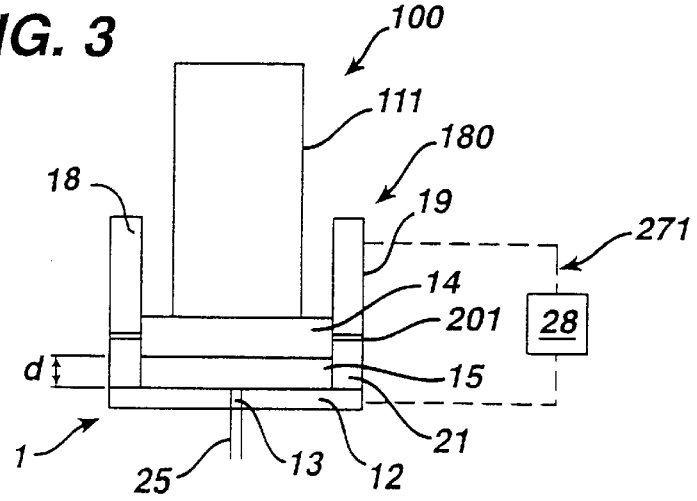
FIG. 3 a part-sectional, side schematic illustration of a further bottom pour structure.

FIGS. 1–3 illustrate configurations of electroslag refining systems with bottom pour structures, within the scope of the invention. In the following figures, like reference characters are used to reference like features. FIG. 1 illustrates a bottom pour structure 1 for one electroslag refining system 10, within the scope of the invention. The electroslag refining system 10 comprises a consumable electrode 11, for example a consumable electrode as set forth in U.S. Pat. No. 5,160,532 to Benz, the entire contents of which are fully incorporated herein by reference. Details to the consumable electrode feed mechanism for the electroslag refining system 10 and the crucible for the electroslag refining system are described in the Benz patent and are not set forth herein.

The bottom pour structure 1 (FIG. 1), as embodied by the invention, comprises a bottom pour structure 12 (hereinafter "bottom pour structure"). The bottom pour structure 12 comprises an orifice or hole 13 through which a stream of liquid metal may be able to flow through. In FIG. 1, the electroslag refining system 10 comprises a slag 14 or "starter plate" of a metallic material, which is disposed on the bottom pour structure 12. The bottom pour structure 12 comprises a lower surface of a reservoir of the electroslag refining system crucible 18. The orifice 13 is initially closed during initiation phases of electroslag refining. The term "initiation phases" means phases in which the electroslag refining has created a stream of refined liquid metal through the orifice 13. During these phases, flow through the orifice 13 may be closed off by the slag 14, which has not been heated to a liquidus state.

The electroslag refining proceeds by applying current through the electroslag refining system. The current melts portions of the consumable electrode 11 including portions of the consumable electrode 11 that are in contact with the slag 14. Thus, with sufficient amounts of the consumable electrode 11 having been melted the slag 14 becoming liquidus. Electroslag refining of the metal from the consumable electrode 11 can occur, as is known in the art. The electroslag refining will then enter a "flow phase" of the electroslag refining operation, in which the melting of the starter plate 14 is complete. The melting of the starter plate 14 may form a refined liquid metal pool 15 above the orifice 13 in the crucible 18. Once the refined liquid metal pool 15 is formed, a stream 25 of refined liquid metal can exit the orifice 13.

As discussed above, the bottom pour structure 1 for an electroslag refining system 10 provides flow without additional heating of the refined liquid metal, by a cold induction guide structure. One bottom pour condition, as embodied by the invention, occurs when the liquid level (alternatively referred to as "depth") in the refined metal pool 15 is low (as discussed below). Another bottom pour condition occurs as heat applied by passing a current for melting the slag 14 is sufficiently high (as discussed below) to create high temperature electroslag refining conditions. These two conditions can be applied individually, or in combination with one another, to achieve bottom pour from a bottom pour structure for electroslag refining, as embodied by the invention.

The electroslag refining configuration of FIG. 1 can achieve both of these bottom pour conditions. For example, the refined liquid metal pool 15 can be formed with an overall depth d. The depth d is at a level sufficient to avoid significant heat loss from in the melted consumable electrode 11. The depth d is dimensioned to provide a liquid level in which the heat derived from the current applied for melting and refining is sufficient to maintain the refined liquid metal sufficiently viscous in the area of the orifice 13 that the refined liquid metal can flow through the orifice 13 without additional heat being applied thereto.

Further, the high temperature bottom pour condition can be obtained with the electroslag refining configuration of FIG. 1 by creating high temperatures during application of current for electroslag refining. The current for electroslag refining is passed through the consumable electrode 11, slag 14 and crucible 18 in a current path 27 illustrated in phantom in FIG. 1. The current path 27 includes a current supply device 28. The current that is applied for melting the consumable electrode 11 and the slag 14 is provided at levels sufficient for melting the consumable electrode 1 and the slag 14, and also is high enough to maintain the refined liquid metal sufficiently viscous in the area of the orifice 13 that the refined liquid metal can flow through the orifice 13 without additional heat being applied thereto.

FIG. 2 illustrates an alternative embodiment of a bottom pour structure 1 in an electroslag refining system 50. The electrode 110 in the electroslag refining system 50 comprises an un-consumable electrode, in which the un-consumable electrode 110 provides a terminal the current being applied for heating and melting of raw material 20. The raw material 20 for refining is provided to the electroslag refining system 50 from any appropriate source that is separate from the current path, and can comprise solid raw material, liquid raw material, particulate raw material, powdered raw material, and combinations thereof. The un-consumable electrode 110 is not consumed, and can comprise a cooled electrode 110. For example, the un-consumable electrode 110 can comprise a coolant-cooled, such as water-cooled, copper electrode. The un-consumable electrode 110 can be provided with appropriate shielding, such as at least one of heat and electrical shielding, for example but not limited to, a molybdenum shielding.

In the electroslag refining system 50 of FIG. 2, raw material 20 is fed from a source into the crucible 18 by any appropriate feed device or means (not illustrated). Current is applied along a current path 25 that includes the unconsumable electrode 110, the liquid slag 14 and the crucible 18 of the electroslag refining system 50. The bottom pour structure I with the electroslag refining system 50, as embodied by the invention, achieves the bottom pour conditions in a manner as described above, and the addition of further heat is avoided.

FIG. 3 illustrates a further bottom pour structure with an electroslag refining system 100, as embodied by the invention for achieving bottom pour conditions in a manner as described above, in which addition of further heat to the refined liquid metal is avoided. The electroslag refining system crucible 18 of FIG. 3 comprises a split-crucible structure 180. The split-crucible structure 180 comprises at least two crucible portions, an upper split-crucible portion 19 and a lower split-crucible portion 21. Each of the split-crucible portions forms a part of the current supply path 271 for the electroslag refining operations. The upper split-crucible portion 19 and lower split-crucible portion 21 are electrically insulated from each other by appropriate electrical insulation 201, thus the current path flows from the upper split-crucible portion 19, into the slag 14, and to a lower split-crucible portion 21.

The electroslag refining system 100 with a bottom pour structure comprises a raw material supply 111. The raw material supply 111 does not form a portion of the current path, from which metal to be melted and refined originates. Therefore, the bottom pour structure with an electroslag refining system 100 can utilize stock consumable electrodes be used as raw material feed, however, connection of the current path 271 to the raw material supply 111 is not needed, as the current path is complete through the split-crucible structure 180 of the electroslag refining system 100.

Electroslag refining by the electroslag refining system 100 with a bottom pour structure 1 and split-crucible structure 180, as embodied by the invention, occurs by passing current from an appropriate current source 28 to the upper split-crucible portion 19. The current can then flow through the slag 14 and to the lower split-crucible portion 21, and back through the current path 27. The bottom pour structure 1 with the electroslag refining system 100, as embodied by the invention, achieves the bottom pour conditions in a manner as described above, and the addition of further heat is avoided.

The rate at which the stream 25 flow through the bottom pour structure 1 in electroslag refining systems within the scope of the invention can be controlled, and adjusted if desired. The control and adjustment of the stream flow may be related to the melt rate of each of the consumable electrode 11, the raw material 20, and the raw material supply 111 that can be adjusted to match the desired stream flow rate. For example, the amount of current that is passed through the current path 27 may be controlled for starting flow, as in the transition from the initiation phase to a flow phase. The flow phase may comprise a steady state flow phase if the current applied, and thus the heat applied, is maintained at a relatively constant current level, in which the term constant is used with its conventional meaning by a person of ordinary skill in the art. Further, the flow rate of the stream may be controlled and varied, if desired, by changing the current level applied thereto, in which lowering an applied current flow may lower a flow rate. Alternatively, increasing the current level may increase the heat applied to the electroslag refining systems, and a corresponding increase in the flow rate of the stream 25.

The level of the refined liquid metal pool 15 in each electroslag refining system may also control the stream 25 flow through the orifice 13. The control of the stream flow generally increases with an increased height of refined liquid metal in the pool. Thus, a deeper pool of refined liquid metal will increase the flow rate of the stream as the pressure applied by the pool itself to the stream will increase its flow. Similarly, reducing the depth of the pool will provide less refined liquid metal in the pool, and thus the flow of the stream will be lessened compared to a deeper pool of refined liquid metal.

While various embodiments are described herein, it will be appreciated from the specification that various combinations of elements, variations or improvements therein may be made by those skilled in the art, and are within the scope of the invention.

We claim:

1. A bottom pour electroslag refining system for refining raw material from a source of raw material into refined liquid metal, the bottom pour electroslag refining system comprising:

an electroslag refining crucible;

a slag;

a bottom pour structure comprising an orifice from which refined liquid metal from the electroslag refining crucible flows from as a stream of refined liquid metal; and a current path defined in the bottom pour electroslag refining system for melting and refining the raw material, the melted and refined raw material forming a refined liquid metal pool in the electroslag refining crucible;

wherein current applied by the current path is sufficient to provide the refined liquid metal in the refined liquid metal pool with a viscosity under which the refined liquid metal flows through the orifice under its own viscosity, and wherein the raw material comprises the source of raw material that is supplied to the electroslag refining crucible, and wherein the source of raw material is independent of the current path.

2. A system according to claim 1, wherein the electroslag crucible is an electroslag refining split-crucible, and wherein the current path comprises the electroslag refining split-crucible, and the current path is defined through the electroslag refining split-crucible.

3. A system according to claim 1, the electroslag refining crucible further comprises an electroslag refining split-crucible, the electroslag refining split-crucible comprises:

an upper split-crucible portion, lower split-crucible portion, and electrical insulation between the upper split-curable portion and the lower split-crucible portion, wherein the current path comprises a path comprising the upper split-crucible portion, the slag, and the lower split-crucible portion.

4. A system according to claim 1, wherein the refined liquid metal pool comprises a depth that is sufficient for the refined liquid metal to possess a viscosity under which the refined liquid metal pool flows through the orifice under its own viscosity.

5. A system according to claim 1, wherein the current path supplies a current at a level sufficient to heat the refined liquid metal pool to a temperature in which the refined liquid metal pool possesses viscosity under which the refined liquid metal flows through the orifice under its own viscosity.

6. A bottom pour electroslag refining method for refining raw material from a source of raw material into refined liquid metal in which the refined liquid metal flows under its own viscosity, the bottom pour electroslag refining method comprising:

providing raw material to be refined;

providing an electroslag refining split-crucible;

providing a slag in the electroslag refining crucible;

providing a bottom pour structure for the electroslag refining crucible comprising an orifice from which refined liquid metal from the electroslag refining crucible flows as a stream of refined liquid metal;

establishing a current path through the electroslag refining split-crucible;

applying current to the raw material from the source of raw material for melting and refining the raw material; and forming a refined liquid metal pool in the electroslag refining crucible;

wherein the step of applying current comprises applying current at an amount that is sufficient to provide the refined liquid metal in the refined liquid metal pool with a viscosity so the refined liquid metal flows out of the orifice under its own viscosity.

7. A method according to claim 6, wherein the electroslag refining split-crucible comprises an upper split-crucible portion, lower split-crucible portion, and electrical insulation between the upper split-curable portion and the lower split-crucible portion, the step of establishing a current path comprises establishing a current path comprising the upper split-crucible portion, the slag, and the lower split-crucible portion.

8. A method according to claim 6, wherein the step of applying current at an amount that is sufficient to provide the refined liquid metal in the refined liquid metal pool with a viscosity so the refined liquid metal flows out of the orifice under its own viscosity comprises:

establishing a refined liquid metal pool that comprises a depth sufficient for the refined liquid metal to maintain a viscosity under which the refined liquid metal pool flows through the orifice under its own viscosity.

9. A method according to claim 6, wherein the step of applying current at an amount that is sufficient to provide the refined liquid metal in the refined liquid metal pool with a viscosity so the refined liquid metal flows out of the orifice under its own viscosity comprises:

applying current at a level that is sufficient to heat the refined liquid metal pool to a temperature in which the refined liquid metal pool maintains a viscosity under which the refined liquid metal flows through the orifice under its own viscosity.

10. A method according to claim 6, further comprising controlling a flow of refined liquid metal from the orifice.

11. A bottom pour electroslag refining method for refining raw material from a source of raw material into refined liquid metal in which the refined liquid metal flows under its own viscosity, the bottom pour electroslag refining method comprising:

providing raw material to be refined;

providing an electroslag refining crucible;

providing a slag in the electroslag refining crucible;

providing a bottom pour structure for the electroslag refining crucible comprising an orifice from which refined liquid metal from the electroslag refining crucible flows as a stream of refined liquid metal;

establishing a current path independent of the source of raw material;

applying current along the current path for melting and refining the raw material; and forming a refined liquid metal pool in the electroslag refining crucible; and controlling the flow of refined liquid metal from the orifice;

wherein the step of applying current comprises applying current at an amount that is sufficient to provide the refined liquid metal in the refined liquid metal pool with a viscosity so the refined liquid metal flows out of the orifice under its own viscosity by at least one of:

establishing a refined liquid metal pool that comprises a depth sufficient for the refined liquid metal to maintain a viscosity under which the refined liquid metal pool flows through the orifice under its own viscosity; and applying current at a level that is sufficient to heat the refined liquid metal pool to a temperature in which the refined liquid metal pool maintains a viscosity under which the refined liquid metal flows through the orifice under its own viscosity.

12. A bottom pour system for electroslag refining of a raw metallic material, the bottom pour system comprising:

means for electroslag refining;

means for applying an electrical current along a current path that is independent of the raw metallic material to the means for electroslag refining; and means for producing a refined liquid metal pool wherein the current applied by means for applying current is sufficient to provide refined liquid metal in the refined liquid metal pool with a viscosity under which the refined liquid metal flows through under its own viscosity.

13. A bottom pour system according to claim 12, further comprising:

a slag;

a bottom pour structure means for providing an orifice from which refined liquid metal flows as a stream; and wherein current applied by the means for applying a current is sufficient to provide the refined liquid metal in the refined liquid metal pool with a viscosity under which the refined liquid metal flows through the orifice under its own viscosity.

* * * * *